United States Patent [19]

Hallay

[11] Patent Number: 4,695,771

[45] Date of Patent: Sep. 22, 1987

[54] IGNITION CIRCUIT FOR HIGH PRESSURE ARC DISCHARGE LAMPS

[75] Inventor: Alexander R. Hallay, Chicago, Ill.

[73] Assignee: Advance Transformer Company, Chicago, Ill.

[21] Appl. No.: 760,000

[22] Filed: Jul. 29, 1985

[51] Int. Cl.[4] ..... H05B 37/00

[52] U.S. Cl. ..... 315/290; 315/209 CD; 315/207; 315/240; 315/244

[58] Field of Search ..... 315/289, 207, 209 CD, 315/127, 219, 239, 240, 244, 290, DIG. 7

[56] References Cited

U.S. PATENT DOCUMENTS

| | | | |
|---|---|---|---|
| 3,466,500 | 9/1969 | Peek | 315/289 |
| 3,522,475 | 8/1970 | Hashimoto | 315/289 |
| 3,758,818 | 9/1973 | Kaneda | 315/290 |
| 4,461,982 | 7/1984 | Fahnrich | 315/289 |
| 4,480,214 | 10/1984 | Sodini | 315/290 |

FOREIGN PATENT DOCUMENTS

| | | | |
|---|---|---|---|
| 0044080 | 4/1977 | Japan | 315/289 |
| 0044078 | 4/1977 | Japan | 315/290 |
| 0010584 | 1/1979 | Japan | 315/290 |

*Primary Examiner*—Leo H. Boudreau
*Assistant Examiner*—Michael Razavi
*Attorney, Agent, or Firm*—Robert T. Mayer; Bernard Franzblau

[57] ABSTRACT

Apparatus for igniting and operating a high pressure arc discharge lamp includes a pulse generating circuit for generating high voltage pulses for starting the lamp. The pulse generating circuit is comprised of a step-up transformer, a start capacitor, a voltage sensitive bidirectional switch (e.g., a sidac) and an impedance which forms a charge circuit for the capacitor. The capacitor discharges via the switch and a part of the transformer to generate a high voltage pulse which is coupled to the lamp electrodes. An auxiliary capacitor and a serially connected inductor are coupled in parallel with the pulse generating circuit so as to clamp the open circuit voltage at a high level upon generation of the ignition pulse thereby to maintain a level of lamp current sufficient to sustain the discharge arc. This makes the lamp ignition more reliable and extends the lamp life.

27 Claims, 10 Drawing Figures

IGNITION CIRCUIT FOR HIGH PRESSURE ARC DISCHARGE LAMPS

BACKGROUND OF THE INVENTION

This invention relates to a circuit for starting and operating a high pressure arc discharge lamp, and more particularly to an ignitor or starting circuit which improves the starting characteristic of a "hot" dual ended high pressure discharge lamp.

Two conditions must be fulfilled in the starting process of a gas discharge lamp. First, the starting circuit must provide sufficient energy in the voltage pulse applied to the lamp electrodes. Second, the circuit must allow enough current to follow through in order to bring the electrodes to the proper emission temperature.

If the second condition is not satisfied, there will be an insufficient flow of current from the AC power supply source which will result in a lowering of the emission temperature of the lamp electrodes which are exposed to the high voltage pulses. This condition will cause sputtering of the electrodes with a concomitant decrease in the life expectancy of the discharge lamp.

It is generally known that a high voltage pulse of a value several times the lamp operating voltage is required to start or ignite certain types of high pressure gaseous discharge lamps such as a high-pressure sodium discharge lamp. U.S. Pat. No. 3,407,334 (10/22/68) in the name of O. G. Attewell, U.S. Pat. No. 3,963,958 (6/15/76) in the name of J. A. Nuckolls and U.S. Pat. No. 4,403,173 (9/6/83) in the name of W. Mayer describe three such ignitor circuits for high-pressure gaseous discharge lamps. In each of these patents a starting capacitor is serially connected with a resistor so that a high voltage starting pulse is obtained upon discharge of the capacitor into a step-up transformer via a voltage threshold device. The transformer has an output winding coupled to the electrodes of the high-pressure discharge lamp. After the lamp ignites, the high voltage discharge pulses are suppressed because the lower value of the lamp operating voltage prevents the starting capacitor from charging up to the breakdown level of the voltage threshold device.

Although the circuits described in the Nuckolls and Attewell patents are adequate for the ignition and operation of standard high-pressure sodium lamps, they are unreliable for the ignition of certain newer types of dual ended electrode halide lamps such as the HQI lamp manufactured by Osram GmbH and others. The older standard high-pressure sodium lamps generally require a starting voltage pulse in the range of 2.5 KV to 4 KV, whereas the HQI type of lamp requires a start voltage pulse in the range of 4 KV to 5 KV.

In these prior art circuits, a substantial dip in the lamp open circuit voltage occurs immediately after the generation of the high voltage ignition pulse. The dip in the lamp voltage is caused by the discharge of the start or surge capacitor when the voltage threshold device "closes". This reduction in voltage means less power is available at the lamp electrodes to sustain the arc discharge immediately after lamp ignition.

Another disadvantage of the above prior art pulse ignition circuits is that, after a momentary interruption of power to the high pressure discharge lamp, reignition of the lamp is not reliable because of the relatively low voltage that is available upon reapplication of the AC supply voltage. The applied high voltage ignition pulses will eventually ignite the lamp, but the low amplitude of the power frequency voltage may cause the lamp to hang up in a "low-glow" mode for a considerable period of time. This in turn will lead to deterioration of the lamp electrodes.

The Mayer patent provides a circuit for starting the newer type of higher pressure metal vapor discharge lamp under cold or warm conditions by means of a pulse superimposition ignition circuit. A starting capacitor and a resistor are serially connected to the AC supply voltage. This series circuit is also connected to the primary winding of a step-up pulse transformer. The transformer secondary winding is coupled to the lamp electrodes. A semiconductor voltage threshold element, such as a four-layer diode, is coupled to the capacitor so as to allow the capacitor to discharge via the transformer primary winding to induce a large number of high voltage pulses in the transformer secondary winding in each half cycle of the AC supply voltage. Mayer also provides an oscillatory circuit composed of an auxiliary capacitor and a serially connected damping resistor which form, together with a ballast choke, a series resonant circuit coupled to the primary winding of the pulse transformer so as to increase the lamp supply voltage during ignition. This ignitor was designed for use with reactor ballasts to ignite lamps which required higher R.M.S. starting voltages than were available from the 220 V power supply. The semiconductor switching element (four-layer diode) disconnects the series resonant circuit after lamp ignition so that in normal operation the lamp will only receive power from the AC supply voltage source.

SUMMARY OF THE INVENTION

In view of the foregoing, it is an object of the invention to provide a new and improved circuit for starting and operating a high pressure arc discharge lamp for use with AC supply voltages as low as 120 volts.

Another object of the invention is to provide a lamp starting and operating circuit that provides a relatively high ratio of the lamp ignition voltage to the lamp operating voltage.

A further object of the invention is to provide a lamp starting and operating circuit that is relatively simple in construction but is nevertheless very reliable in operation.

Another object of the invention is to provide an improved lamp starting circuit of the capacitor discharge type which maintains an adequate level of power frequency voltage and thereby provides a more reliable ignition of a high-pressure arc discharge lamp.

A still further object of the invention is to provide an improved circuit for starting and operating a high-pressure arc discharge lamp which provides reliable reignition of a high-pressure lamp after a power interruption of short duration.

It is still another object of the invention to provide a starting and operating circuit for a high pressure discharge lamp in which conventional types of ballasts may be used.

These and other objects of the invention are accomplished by the addition of a further storage capacitor serially connected with a coil to the basic capacitor discharge type of starting circuit in a manner so as to clamp the open circuit voltage upon ignition of the high pressure gas discharge lamp thereby to maintain the lamp voltage at a high enough level to provide a sufficient current to sustain the discharge arc.

BRIEF DESCRIPTION OF THE DRAWINGS

The invention, together with further objects and advantages thereof will be better understood by reference to the following detailed description taken in conjunction with the accompanying drawing in which.

DETAILED DESCRIPTION OF THE DRAWINGS

Figure 1:
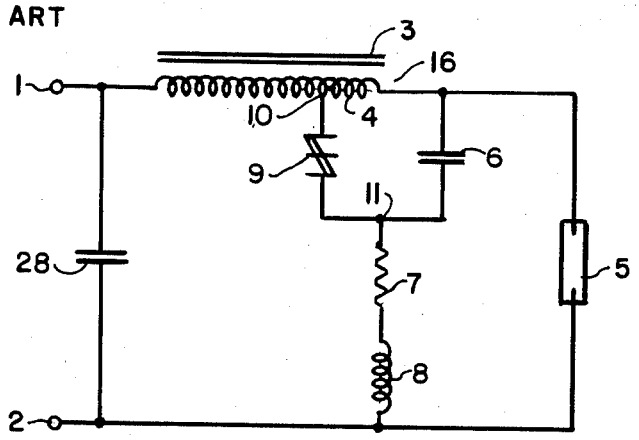
FIG.1 PRIOR ART
FIG. 1 is a circuit diagram of the basic prior art type of capacitor discharge starting circuit for a high pressure discharge lamp utilizing a reactor ballast.

FIG. 1 illustrates the essential elements of the basic prior art capacitive discharge starting circuit for a high-pressure arc discharge lamp. The AC supply voltage, for example 220 volts at a frequency of 60 Hz, is connected to input terminals 1 and 2. Input terminal 1 is connected via a series connection of an iron core inductive reactor type ballast 3 to one electrode of a high pressure sodium discharge lamp 5. The ballast 3 provides the customary current limiting impedance. The other input terminal 2 is directly connected to the other lamp electrode. This type of lamp requires a relatively high voltage pulse in order to be ignited, e.g. 2.5 KV–4 KV, and thereafter operates on a much lower voltage, such as 95–105 volts.

In order to generate high voltage starting pulses for the lamp 5, the inductive ballast 3 is connected as a step-up autotransformer having a primary winding 4 defined by the winding turns between one end 16 and a tap point 10 of the ballast. A pulse discharge capacitor 6 has one electrode connected to the junction point 16 between transformer winding 4 and the one electrode of the discharge lamp. The other electrode of capacitor 6 is connected to input terminal 2 via a series circuit consisting of a resistor 7 and an inductor 8. A normally open bidirectionally conductive voltage sensitive switch 9 is connected to the tap point 10 on the pulse autotransformer and to a circuit junction point 11 between the capacitor 6 and the resistor 7. The switch 9 may be a bidirectional semiconductor switching device such as a Triac, a Sidac, or a four-layer diode.

A capacitor 28 is connected across the input terminals 1, 2 and serves to improve the power factor.

It will be appreciated that before the lamp 5 has ignited, it will present an open circuit to the autotransformer. Initially, when power is applied to the input terminals, the capacitor 6 will begin to charge up via the ballast inductor 3, the resistor 7 and the inductor 8. The rate of charge of the capacitor will be governed by the time constant of this circuit.

When the capacitor voltage reaches the predetermined threshold or breakdown voltage of the voltage sensitive switch 9, the switch closes to allow the capacitor 6 to discharge through the primary winding 4 of the autotransformer, i.e. that part of the winding between tap point 10 and junction point 16. The primary voltage is stepped up by the transformation ratio of the autotransformer to produce a pulse voltage across the entire winding of sufficient amplitude to ignite the discharge lamp 5. The ignition pulse generated is superimposed upon the 60 Hz AC waveform supplied from input terminals 1 and 2 and is arranged to occur near the peak of the AC supply voltage waveform.

When the lamp becomes conductive, the output voltage of the reactor ballast will be limited to the operating voltage of the lamp, which is considerably lower than the lamp ignition voltage. As a result, the capacitor 6 will no longer charge up to a voltage value sufficient to fire the solid state switch 9 so that the switch will remain in its open circuit condition while the lamp is conductive. This effectively removes the starting circuit from the lamp supply system so that further ignition pulses are inhibited during the time that the lamp is in operation (conductive).

During operation of the lamp, the reactor 3 operates to provide the lamp ballast function as is conventional in discharge lamp circuits.

It has been found that with the conventional values of the circuit elements used in this prior art circuit, upon the discharge of capacitor 6 the peak voltage available at the lamp electrodes drops from a value of approximately 300 volts to a value of 180 volts. This reduced voltage is sufficient to maintain reliable conduction in some high-pressure lamps, but is not sufficient to maintain reliable conduction in some other high-pressure lamps. This problem is especially severe in the case of the restart of a "hot" HQI lamp, i.e. upon the reapplication of power to the input terminals after a momentary power interruption during normal operation (conduction) of the HQI lamp.

In the case of reignition of a hot HQI lamp, a reduction of the voltage below the 180 volt level upon discharge of the start capacitor 6 will not sustain conduction in the lamp. This reduction in voltage means less power is available at the lamp electrodes to sustain the arc discharge immediately after ignition.

As the lamp cools down and the start circuit continues to generate high-voltage ignition pulses, the lamp will eventually ignite, but the low recovery voltage may cause it to hang up in a condition of lower than normal light output for a period of time, leading to deterioration of the lamp electrodes. This will reduce the life expectancy of the HQI lamp. The generation of ignition pulses during the extended time period when the lamp is cooling down produces further deterioration of the lamp electrodes. Exposure of the lamp electrodes to high voltage ignition pulses when the emission temperature of the lamp electrodes is lowered produces sputtering of the electrodes and a decrease in the life of the lamp.

Figure 2:
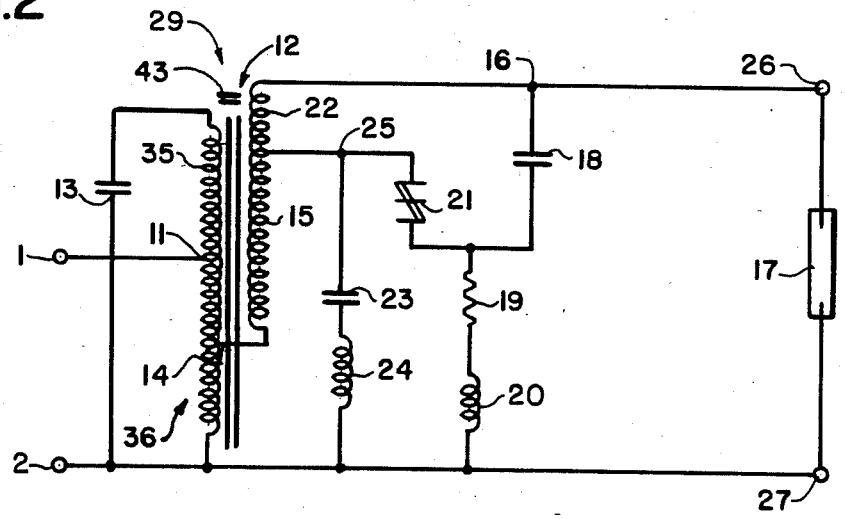
FIG. 2 is the circuit diagram of a preferred embodiment using a high reactance autotransformer for starting and operating a high-pressure discharge lamp.

Referring now to FIG. 2 of the drawing, which illustrates a preferred embodiment of the invention that substantially eliminates the aforesaid drawbacks of the prior art circuit of FIG. 1, there is shown a pair of input terminals 1 and 2 for connection to a source of low frequency AC supply voltage, for example 120 volts at a frequency of 60 Hz. Input terminal 1 is connected to a tap point 11 on a high reactance ballast autotransformer 12 comprising windings 35, 36, 29 and magnetic shunt 43. An extension winding 35 of the autotransformer has a top end terminal connected to one terminal of a power factor correction capacitor 13. The other terminal of capacitor 13 is connected to a common junction point between input terminal 2 and the bottom end terminal of the autotransformer winding 36. The power factor correction capacitor 13 thus is connected across a pair of end terminals of the ballast autotransformer.

A further tap point 14 on the primary winding of the autotransformer is connected to one end of the secondary winding 29 of the autotransformer. The windings 15, 22 together form a pulse autotransformer 29 for generating a high voltage ignition pulse for the high pressure discharge lamp 17. Windings 35, 36, 15 and 22 are magnetically coupled to one another. The other end 16 of the pulse autotransformer 29 is connected to one electrode of a high pressure gas discharge lamp 17 via an output terminal 26. The other electrode of discharge lamp 17 is connected to input terminal 2 via output terminal 27.

A starting capacitor 18 is connected in series with a resistor 19 and a first inductor 20 between the circuit point 16 and the input terminal 2. A normally open voltage sensitive semiconductor switch 21 having a predetermined breakover voltage is connected across the series connection consisting of the primary winding 22 of the pulse autotransformer and the ignition capacitor 18. The switching device 21 may be a bilateral switch such as a Sidac having a threshold voltage of approximately 240 volts. This device may also be any other switch suitable for this application. The circuit consisting of elements 15–22 is similar to the circuit described above in connection with FIG. 1 of the drawing.

In accordance with the invention, a further capacitor 23 and a small inductor 24 are connected in a second series circuit between a junction point 25 (between one terminal of switch 21 and one terminal of the winding 22) and input terminal 2. The capacitor 23 effectively clamps the open circuit voltage of the lamp so as to reduce the voltage dip after capacitor 18 discharges via switch 21 and winding 22 to generate the high voltage ignition pulse for the discharge lamp. The capacitor 23 maintains the lamp voltage at a relatively high voltage level during the discharge of ignition capacitor 18. The inductor 24 prevents a short circuit of the high frequency ignition pulse generated in the pulse autotransformer 29 during the discharge of capacitor 18.

Figure 4:
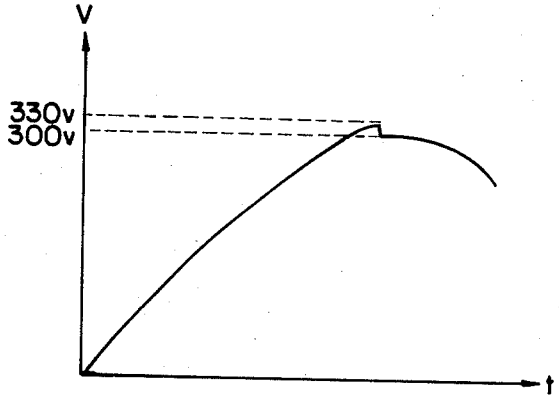

When the input terminals 1, 2 are connected to a source of AC supply voltage, the capacitor 18 is initially charged via the windings 15, 22 of pulse autotransformer 29 and resistor 19 and inductor 20. At the same time, the capacitor 23 is charged via winding 15 and inductor 24. When the voltage across capacitor 18 reaches the breakover voltage of bilateral switch 21, the capacitor discharges via the switch 21 and winding 22 of the pulse autotransformer 29. By step-up autotransformer action, a high voltage, e.g. between 4 KV and 5 KV, is generated across the entire winding 29. This high voltage pulse is transferred to the terminals of the lamp 17 via the stray capacitance (not shown) between winding 15 and the common line connecting terminals 2 and 27. The stray capacitance provides a low impedance path for high frequency components of the generated pulse voltage. At the same time, capacitor 23 clamps the power frequency voltage at the lamp terminals to a sufficiently high voltage level to insure reliable ignition of the lamp (FIG. 4).

Once the lamp is in operation, the voltage across its terminals drops to the arc voltage of the lamp. This clamps the voltage across capacitor 18 to a level below the threshold voltage of the switching device 21, thereby inhibiting the generation of any high voltage pulses during normal lamp operation.

During the ignition phase, the serially connected inductor 24 presents a high impedance path to the discharge of capacitor 18, i.e. it acts as a high impedance to the generated pulse so that the required pulse amplitude is not attenuated. The high reactance ballast function for the lamp 17 is provided by the windings of autotransformer ballast 12, including winding 29.

Once the lamp is ignited, its operation is controlled by the high leakage reactance of the autotransformer ballast by limiting the lamp current in a manner similar to that of the simple reactor serially connected to the lamp in FIG. 1. The starting process, however, is improved by providing a higher level of power frequency voltage at the lamp terminals at the time of pulse generation thereby to sustain the arc.

The circuit in accordance with the invention also makes it possible to restart the lamp in a more reliable manner in the event of a momentary interruption of power at input terminals 1 and 2 after the lamp has been in operation, i.e. an improved restart operation of a warm high-pressure discharge lamp.

Figure 3:
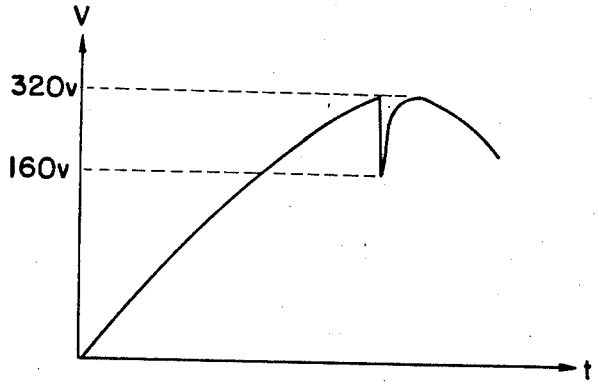
FIGS. 3 and 4 show waveforms which illustrate the improved operating characteristics of the invention over prior art devices.

In one preferred embodiment of the invention, capacitor 13 was an 8/μF (300 V) capacitor. Capacitor 18 was 0.33/μF (400 V) and capacitor 23 was 0.47/μF (400 V). Resistor 19 was 3.5 Kohm (20 W). Inductors 20 and 24 were each 60 mH and the semiconductor switch 21 was a Sidac (235 $V_{bo}$). The lamp 17 was a 70 watt HQI lamp of the type manufactured by Osram (GmbH). Comparison tests performed on this lamp showed that in the circuit of FIG. 2, but without capacitor 23 and inductor 24, i.e. a prior art circuit similar to FIG. 1 and without the present invention, the peak open circuit voltage available to ignite the lamp dropped from an open circuit level of approximately 320 volts to a recovery level in the order of 160 volts, as shown in the waveform in FIG. 3 of the drawing. This latter voltage is not adequate to provide satisfactory ignition in the HQI lamp.

In contrast, when the series circuit of capacitor 23 and inductor 24 was included in the circuit, as shown in FIG. 2, the recovery voltage was in the order of 300 volts with an open circuit voltage of approximately 330 volts peak. This is illustrated in the waveform of FIG. 4 of the drawing. The invention thus maintains a high level of voltage across the lamp during the discharge of starting capacitor 18. This voltage is sufficient to start a cold or warm HQI lamp upon the application or reapplication of power and causes sufficient lamp current to flow to maintain conduction and thereby minimize the lamp life problem otherwise caused by electrode sputtering.

Figure 5:
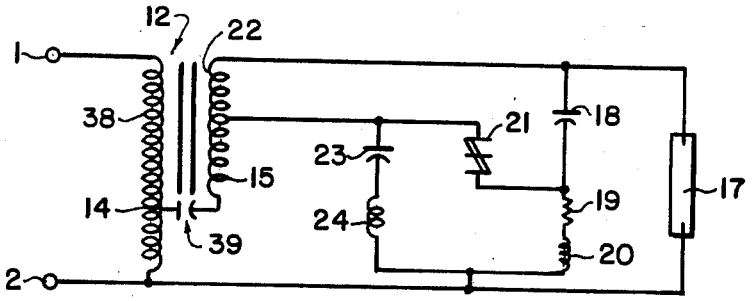
FIG. 5 is a modified form of the apparatus illustrated in FIG. 2 arranged to employ a constant wattage autotransformer.

FIG. 5 illustrates a modified form of the invention shown in FIG. 2, which operates as a so-called constant wattage autotransformer. In this embodiment the AC supply voltage at terminals 1 and 2 is connected across a winding 38 of a ballast autotransformer. A tap point 14 is connected to a winding 15, 22 of the ballast autotransformer via a capacitor 39, which improves the regulation characteristics of the ballast circuit over that of the high reactance circuit shown in FIG. 2.

The operation of the ignitor circuit for the constant wattage autotransformer ballast configuration is similar to that of the high leakage reactance autotransformer circuit in FIG. 2, previously described.

Figure 6:
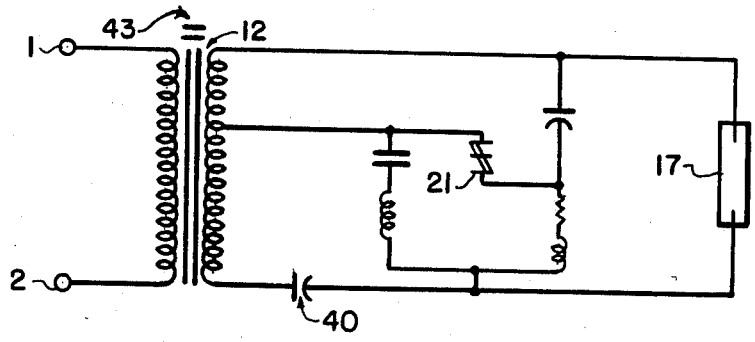
FIG. 6 is a circuit diagram of a constant wattage isolated transformer form of the invention.

FIG. 6 employs the invention in conjunction with a constant wattage isolation transformer. The secondary winding of the ballast transformer now provides the additional function of a step-up pulse autotransformer. A capacitor 40 is connected between the lower end terminal of the transformer secondary winding and one electrode of the high pressure discharge lamp. This capacitor corrects the power factor and also provides better current regulation when the lamp is in operation. The entire lamp circuit is electrically isolated from the input terminals 1, 2. Once again the operation of the ignitor circuit is similar to that of the high leakage reactance autotransformer in FIG. 2.

Figure 7:
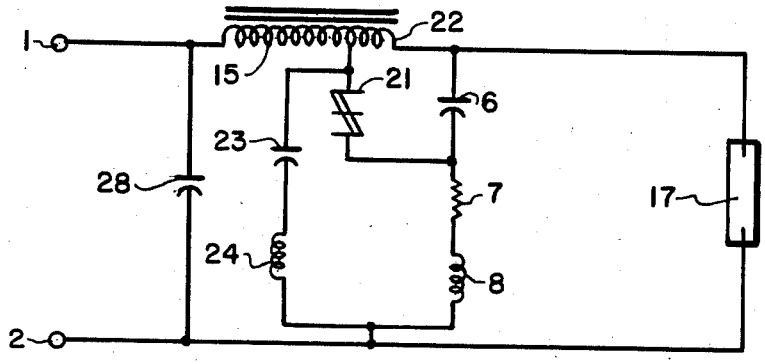
FIG. 7 is a circuit diagram of the invention applied to the prior art apparatus of FIG. 1, again using a simple reactor ballast.

FIG. 7 illustrates the invention applied to the basic reactor ballast circuit of FIG. 1. The power factor correction capacitor 28 connected across the input terminals may not be required in certain applications.

This circuit operates as described above, except that now the series circuit of capacitor 23 and inductor 24 clamp the lamp voltage when the capacitor 6 discharges via the bilateral voltage dependent semiconductor switching device 21. The dip in the open circuit voltage at the lamp electrodes during generation of the high voltage ignition pulse in this circuit is much smaller than that in the circuit of FIG. 1 and thereby provides improved lamp ignition.

Figure 8:
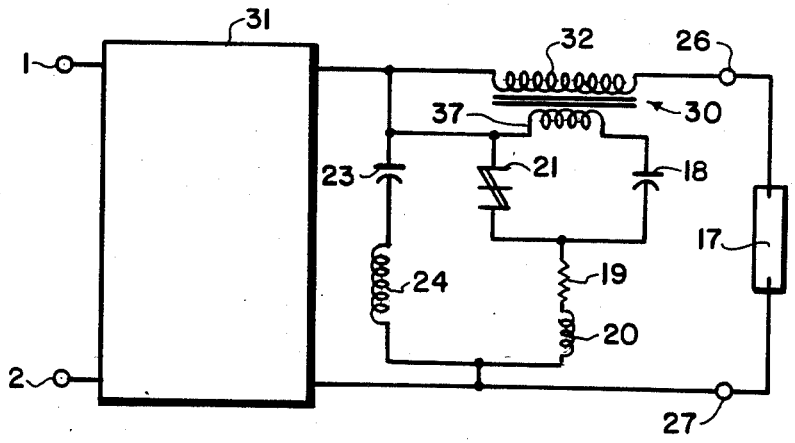
FIG. 8 illustrates an embodiment of the invention which employs a self-contained pulse transformer.

FIG. 8 illustrates the invention employed in an operating circuit for a high pressure discharge lamp 17 which utilizes a separate self-contained pulse transformer 30. The ballast means 31 may now be of a conventional nature such as in FIGS. 2, 5, 6 and 7 and is therefore shown in block form in the interest of brevity. Elements which are the same as those shown in FIG. 2 bear identical reference numerals. The primary winding 37 of the pulse transformer provides a charge path for start capacitor 18 which also includes a resistor 19 and an inductor 20 in series therewith.

The 60 Hz power from input terminals 1 and 2 charges capacitor 18 via the series circuit of winding 37, resistor 19 and inductor 20 and via the ballast device 31. At the same time, 60 Hz power from the ballast device 31 charges the capacitor 23 via inductor 24.

When the capacitor 18 is charged to the threshold voltage of bilateral semiconductor switching device 21, it discharges into primary winding 37 which, via the voltage step-up action provided by the proper ratio of turns of the secondary winding 32, produces a high voltage high frequency ignition pulse or pulses of sufficient magnitude to ignite the lamp 17.

The series circuit of capacitor 23 and inductor 24 clamps the voltage at the lamp terminals to a sufficiently high level so as to provide the improved ignition operation described above in connection with FIG. 2.

After the lamp ignites and is in operation, the secondary winding 32 and the ballast means 31 together limit the lamp current in the usual manner. The lower operating voltage across the lamp terminals inhibits further operation of the high voltage pulsing mechanism by preventing capacitor 18 from charging to the breakdown voltage of the switching device 21.

Figure 9:
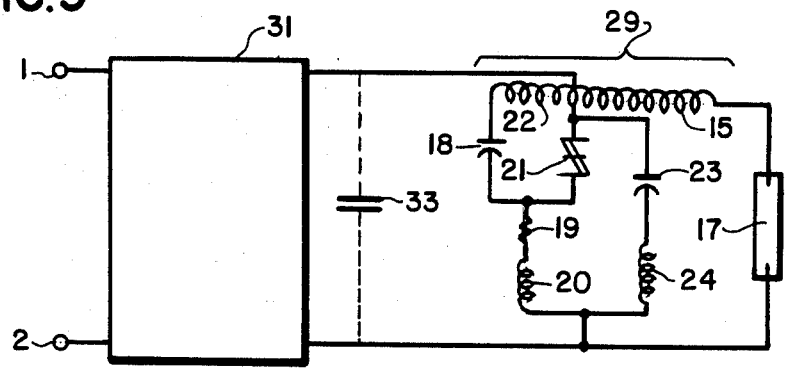
FIG. 9 is a circuit diagram of the invention which employs a self-contained pulse autotransformer.

FIG. 9 illustrates another form of the invention which now uses a self-contained pulse autotransformer. In this circuit the pulse ignition capacitor 18 is charged via the primary winding 22 of a step-up pulse autotransformer 29 having a secondary winding 15. The stray capacitance 33 is shown between the output lines of the ballast means 31. The stray capacitance provides a virtual short circuit path for the high frequency components of the generated high voltage pulse.

The ignition and operation of the lamp are self-evident from the description provided above for FIGS. 1, 2 and 8. The secondary winding 15 assists in the ballast function for the lamp when it is in operation.

This embodiment of the invention also provides a compact device and affords a high degree of flexibility.

Figure 10:
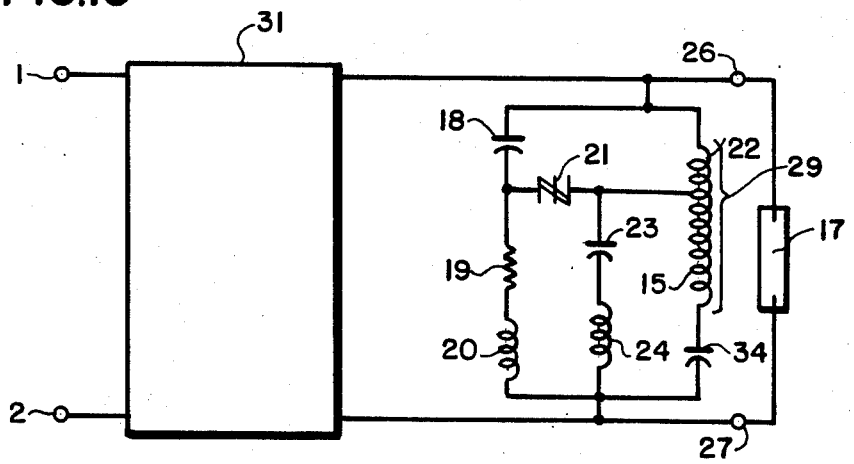
FIG. 10 illustrates a version of the invention which employs a self-contained autotransformer wherein the pulse ignition mechanism is in parallel with the lamp connected to the apparatus output terminals.

FIG. 10 shows a modified form of the invention also using a self-contained pulse autotransformer 29. All of the components making up the high voltage pulse generator are connected in parallel with the output terminals 26, 27. In this circuit the charge path for the pulse ignition capacitor 18 is resistor 19 and inductor 20.

When the capacitor 18 is charged to the threshold voltage of the normally open voltage sensitive semiconductor switching device 21, the switching device begins to conduct so that the capacitor rapidly discharges via the switching device and the primary winding 22 of pulse autotransformer 29. A high voltage pulse is then generated by means of the step-up winding turns in the autotransformer 29 and is applied across the discharge lamp 17 via a capacitor 34. The series circuit of capacitor 23 and inductor 24 connected between the output terminal 27 and the junction point between the switching device 21 and a tap point on the autotransformer again operates to maintain a higher power frequency voltage level at the lamp electrodes as capacitor 18 discharges into the primary winding of the autotransformer. The capacitor 23 was initially charged via the primary winding 22 and the series inductor 24.

Ignition of the lamp reduces the voltage across the lamp terminals to the lamp arc voltage and, as before, operates to inhibit the further generation of ignition pulses by limiting the voltage to which capacitor 18 can charge to a level below the threshold level of the voltage sensitive switching device 21. During operation of the lamp, the pulse autotransformer 29 carries a small current and hence does not contribute any power losses to the circuit. A higher efficiency is therefore obtainable with this embodiment of the invention than with the embodiments utilizing a self-contained transformer or autotransformer.

The capacitor 34 is connected in series with the pulse autotransformer 29 in order to limit the power frequency current flow therein, thereby making it possible to use a smaller pulse autotransformer. If the capacitance of capacitor 34 is relatively small, it will provide sufficient impedance to the 60 Hz supply voltage, while acting as a very low impedance to the high frequency pulse generated in the pulse autotransformer 29.

The circuits in accordance with the invention can be made to operate other HQI lamps or high-pressure sodium lamps of the same nominal lamp voltage. By appropriate choice of the circuit component values, the circuit can be designed to operate other discharge lamps that have different pulse voltage requirements and different lamp operating characteristics.

While the invention has been illustrated and described with respect to a particular preferred embodiment thereof, it will be understood that various modifications of the invention disclosed will become apparent to those skilled in the art. Accordingly, the invention is not to be limited by the described apparatus, but is intended to cover all modifications and equivalents within the scope of the appended claims.

What is claimed is:

1. Apparatus for igniting and operating a high-pressure discharge lamp comprising:

a pair of input terminals for connection to a source of low frequency AC supply voltage, a pair of output terminals for connection to the electrodes of the high-pressure discharge lamp, inductance means including a step-up transformer having a secondary winding coupled to at least one of said output terminals and a primary winding, a first capacitor, an impedance means, means connecting asid first capacitor and said impedance means in a first series circuit, first means coupling said first series circuit to said input terminals via at least a part of said inductance means, a voltage sensitive switching element coupled to said first capacitor and to said transformer primary winding and operable to at least partly discharge the first capacitor via said primary winding when the voltage across the first capacitor equals a predetermined breakdown voltage of the switching element, thereby to induce a high voltage ignition pulse in the transformer secondary winding, and second means coupling a second capacitor to a winding of said transformer and to the other one of said output terminals, said second capacitor having a capacitance value such that the impedance of the second capacitor at the supply voltage frequency allows the second capacitor to develop a voltage that closely follows the AC supply voltage and, upon discharge of the first capacitor, the second capacitor maintains a high voltage level across said output terminals that closely approximates the level of the AC supply voltage at the time of discharge of the first capacitor.

2. Apparatus as claimed in claim 1 further comprising an inductor connected in series with the second capacitor between said transformer winding and said other one of said output terminals.

3. Apparatus as claimed in claim 2 wherein said first capacitor and the switching element are connected in series across the transformer primary winding and the series connection of the second capacitor and the inductor is connected between one terminal of the primary winding and said other one of said output terminals via a circuit that bypass the first capacitor and the switching element.

4. Apparatus as claimed in claim 3 wherein said transformer comprises an autotransformer with the secondary winding connected between one of said input terminals and said one output terminal and with the primary winding comprising a part of the winding between said one output terminal and a tap point on the secondary winding, said tap point being connected to the switching element and to the second capacitor.

5. Apparatus as claimed in claim 2 wherein said transformer comprises an autotransformer with the secondary winding connected between one of said input terminals and said one output terminal and with the primary winding comprising a part of the winding between said one output terminal and a tap point on the secondary winding, said tap point being connected to the switching element and to the second capacitor.

6. Apparatus as claimed in claim 1 wherein said transformer comprises an autotransformer with the secondary winding connected between one of said input terminals and said one output terminal and the primary winding has a first terminal that comprises a tap point on the secondary winding which is connected to the switching element and to the second capacitor and a second terminal connected to the first capacitor so that the transformer primary and secondary windings, along with said impedance means, form a charge path for the first capacitor that excludes the second capacitor for current from said input terminals.

7. Apparatus as claimed in claim 6 wherein the other input terminal is connected to the other one of said output terminals.

8. Apparatus as claimed in claim 2 wherein said transformer comprises an autotransformer with the secondary winding connected between one of said input terminals and said one output terminal and the primary winding comprises a tap point on the secondary winding which is connected to the switching element and to the second capacitor, and means connecting said first capacitor and the switching element in series across the transformer primary winding, said impedance means being connected between a junction point of the first capacitor and the switching element and the other input terminal.

9. Apparatus as claimed in claim 1 wherein the switching element comprises a bidirectional semiconductor device with a voltage breakdown value related to the ignition voltage of a discharge lamp to be connected to the output terminals, means connecting said first capacitor and the switching element in series across the transformer primary winding with said impedance means being connected between a junction point of the first capacitor and the switching element and the other input terminal, and wherein the second capacitor is connected in parallel with the series connection of the switching element and the impedance means.

10. Apparatus as claimed in claim 2 wherein the impedance means comprise a resistor and a second inductor serially connected with the first capacitor.

11. Apparatus as claimed in claim 2 wherein said inductance means comprises an input winding of said transformer coupled to said input terminals and with a terminal of the input winding coupled to said secondary winding via a third capacitor.

12. Apparatus as claimed in claim 1 wherein the transformer includes a secondary winding coupled between one of said input terminals and said one output terminal and the primary winding is connected in series with the first series circuit across the input terminals to provide a charge current path for the first capacitor that excludes the secondary winding.

13. Apparatus as claimed in claim 12 further comprising an inductor connected in series with the second capacitor to form a second series circuit connected between a terminal of the secondary winding and the other one of said output terminals.

14. Apparatus as claimed in claim 2 wherein the transformer comprises a separate autotransformer, a third capacitor, said third capacitor being connected in a second series circuit with the primary and secondary windings of the autotransformer, means connecting the second series circuit in parallel with the output terminals, said first series circuit being coupled in parallel with the second series circuit.

15. Apparatus as claimed in claim 14 wherein said first capacitor and the switching element are connected in series across the transformer primary winding and the series connection of the second capacitor and the inductor is connected between one terminal of the primary winding and said other one of said output terminals.

16. Apparatus as claimed in claim 5 wherein the secondary winding is directly connected to said one input terminal and the primary and secondary windings of the autotransformer comprise the major ballast elements for the discharge lamp.

17. Apparatus as claimed in claim 2 wherein said inductance means includes an input winding of said transformer coupled to the input terminals, and wherein said primary and secondary windings of the transformer together form an autotransformer wherein the secondary winding is coupled to the other one of said output terminals via a third capacitor, and wherein the primary and secondary windings, the first and second capacitors, the switching element and the impedance means are all electrically isolated from the input terminals by means of said transformer.

18. An ignitor for a gas discharge lamp comprising: first and second terminals for connection to a step-up transformer and a third terminal for connection to a lamp electrode, a first capacitor and an impedance means connected in series circuit between said first and third terminals, a bidirectional voltage sensitive semiconductor switching element having a predetermined voltage threshold level connected between the second terminal and a terminal of the first capacitor remote from the first terminal, and a second capacitor and an inductor connected in a second series circuit between said second and third terminals so as to shunt the bidirectional voltage sensitive semiconductor switching element.

19. Apparatus for igniting and operating a high-pressure discharge lamp comprising:

a pair of input terminals for connection to a source of AC supply voltage, a pair of output terminals for connection to the electrodes of the high-pressure discharge lamp, a step-up transformer having a high voltage winding coupled to said output terminals and a low voltage winding, a first capacitor and a first impedance means connected in a first series circuit and coupled to said low voltage winding and to said input terminals so that the first capacitor can be charged up from a supply voltage applied to the input terminals, a voltage sensitive semiconductor switching device coupled to the first capacitor and the low voltage winding whereby the first capacitor can discharge via the switching device and the low voltage winding when the capacitor voltage reaches a predetermined threshold voltage level of the switching device, thereby to induce a high voltage ignition pulse in the transformer high voltage winding, and a second capacitor and an inductor connected in a second series circuit to a terminal of the primary winding and to one of said output terminals.

20. Apparatus as claimed in claim 2 wherein said first coupling means couples the first series circuit to the input terminals via a part of said inductance means that excludes at least one of said windings of the step-up transformer.

21. Apparatus as claimed in claim 19 wherein the second series circuit is connected between said terminal of the primary winding and said one output terminal via a circuit that bypasses the first capacitor and the switching device.

22. Apparatus as claimed in claim 19 wherein the first capacitor is charged up from the supply voltage at the input terminals via a circuit that bypasses the second capacitor and the inductor.

23. Apparatus as claimed in claim 19 wherein said first series circuit has a time constant such that the first capacitor reaches the switching device breakdown voltage in the vicinity of the maximum amplitude of the AC supply voltage at the input terminals.

24. Apparatus as claimed in claim 23 wherein said time constant of the first series circuit allows the first capacitor to reach the voltage-sensitive switching element breakdown voltage only once per half cycle of the AC supply voltage thereby to induce only one high voltage ignition pulse per half cycle of the AC supply voltage.

25. Apparatus as claimed in claim 1 wherein the second coupling means couples the second capacitor between said transformer winding and said one output terminal via a circuit that bypasses the first capacitor and the voltage-sensitive switching element.

26. Apparatus as claimed in claim 2 wherein the second capacitor provides a low impedance path to the low frequency AC supply voltage whereby it stores sufficient electric energy so that, during the ignition pulse, the output voltage at the output terminals is maintained at a value of approximately 90% or more of the AC supply voltage at the input terminals.

27. Apparatus as claimed in claim 19 wherein the capacitance values of the first asnd second capacitors are of the same order of magnitude so that each provides a low impedance path for current at the frequency of the AC supply voltage.

* * * * *